US006582139B2

(12) United States Patent
Abe et al.

(10) Patent No.: US 6,582,139 B2
(45) Date of Patent: Jun. 24, 2003

(54) DISCHARGED SHEET STACKER OF RECORDING APPARATUS AND RECORDING APPARATUS PROVIDED WITH DISCHARGED SHEET STACKER

(75) Inventors: Mikinobu Abe, Nagano (JP); Mugio Kawasaki, Nagano (JP); Hirokazu Yamano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 78 days.

(21) Appl. No.: 09/835,848

(22) Filed: Apr. 17, 2001

(65) Prior Publication Data

US 2002/0006301 A1 Jan. 17, 2002

(30) Foreign Application Priority Data

Apr. 17, 2000 (JP) ..... 2000-115163
Jul. 21, 2000 (JP) ..... 2000-220045
Jul. 21, 2000 (JP) ..... 2000-220047

(51) Int. Cl.[7] ..... B41J 29/00

(52) U.S. Cl. ..... 400/599.1; 400/625; 400/693; 271/3.01; 271/207; 271/213; 399/110

(58) Field of Search ..... 400/691, 693, 400/624, 625, 599.1; 399/110; 347/104; 271/3.01, 207, 213, 220, 222, 223, 224

(56) References Cited

U.S. PATENT DOCUMENTS 5,113,222 A * 5/1992 Wilson et al. ..... 399/81
5,454,555 A * 10/1995 Kiyohara et al. ..... 271/126
5,680,166 A * 10/1997 Nishiberi ..... 347/104
5,737,097 A * 4/1998 Fujimoto ..... 358/400
6,009,302 A * 12/1999 Worley et al. ..... 271/121
6,040,919 A * 3/2000 Iwata et al. ..... 358/400
D429,279 S * 8/2000 Dwyer et al. ..... D18/55

* cited by examiner

*Primary Examiner*—Andrew H. Hirshfeld
*Assistant Examiner*—Dave A. Ghatt
(74) *Attorney, Agent, or Firm*—Sughrue Mion, PLLC

(57) ABSTRACT

A stacker on which a recording medium discharged from an outlet of a recoding apparatus is placed, is movable between a first position for closing the outlet and a second position for opening the outlet. A sheet receiving face receives the discharged recording medium, while being a first form when the stacker is placed in the first position, and being a second form when the stacker is placed in the second position. The sheet receiving face is formed with at least one aperture in an upstream end portion with regard to a sheet discharging direction. A holder supports the upstream end portion of the sheet receiving face. The holder includes at least one retainer engaged with the aperture so as to prevent the sheet receiving face from deforming upward.

38 Claims, 15 Drawing Sheets

DISCHARGED SHEET STACKER OF RECORDING APPARATUS AND RECORDING APPARATUS PROVIDED WITH DISCHARGED SHEET STACKER

BACKGROUND OF THE INVENTION

The present invention relates to a discharged sheet stacker adaptable for use with a recording apparatus, such as a printer or a copying machine, and relates to a recording apparatus provided with the discharged sheet stacker.

An example of a related discharged sheet stacker in use for a recording apparatus, such as a printer or a copying machine, is constructed as follows. A pivotable member made of a rigid material is turned to be horizontal to be used as the discharged sheet stacker. When not used, it is turned to be vertical to close the front face of the printer body. For another example, it is constructed a discharged sheet stacker includes an extension stacker which may be drawn out of the turn member in accordance with a size of a sheet of paper. When the extension stacker is thus drawn out, it receives the sheet of a large size.

A related printer is shown in FIG. 19. A sheet supply tray 201 made of a hard material is removably attached to the rear side of a printer body 200 whose external configuration is almost cuboid. A discharged sheet stacker 203 made of a hard material is removably attached to the front side of the printer body, while being extensible to the front.

In recent years, it is required that the product with stylish design which matches a life style of the user. Thus, in recent product development, one of the subjects assigned to the product manufacturer is not only to improve the functional aspect but also to improve the design stylishness which satisfies user's needs. For this reason, it is required to develop a variety of products designed on the basis of one product concept "soft impression".

Where the discharged sheet stacker made of the rigid material or hard material is used, a design freedom is frequently restricted in designing products based on the "soft impression" concept. In a printer of such a type that the discharged sheet stacker is closed in the housing, if the form of the discharged sheet stacker made of the rigid material is determined, then the form of the housing itself must be restrictively determined in accordance with the form of the discharged sheet stacker.

The discharged sheet stacker includes a sheet receiving face which is bendable, wherein when the stacker is used, the sheet receiving face is substantially horizontal for receiving sheets of paper, and when the stacker is closed in its place, the sheet receiving face may be deformed along the outer configuration of the housing.

A standby position of a carriage with an ink cartridge mounted thereon is located in one of the right and left end portions of the printer. Accordingly, the center line of the housing is not coincident with the center line of the opening through which the sheets are discharged. For this reason, when the discharged sheet stacker is closed in a state that it is deformed along the configuration of the housing, the stacker deformed is asymmetrical with respect to its center line. As a result, when the discharged sheet stacker is used, the stacker has had the tendency to deform, and hence one of the sides of the stacker is raised.

SUMMARY OF THE PREFERRED EMBODIMENTS

It is therefore a first object of the present invention is to provide a discharged sheet stacker having such a structure that in designing the product based on the concept of "soft impression", a design freedom is increased regardless of the discharged sheet stacker made of the rigid material, which the stacker is compact when it is closed, and protects the sheet discharge section against dust, and to provide a recording apparatus with such a discharged sheet stacker.

A second object of the present invention is to provide a discharged sheet stacker which functions such that even when the deformable discharged sheet stacker has had the tendency to deform, its tendency to deform is removed and its original configuration is resumed when it is used, and a recording apparatus with such a discharged sheet stacker.

In order to achieve the above objects, according to the present invention, there is provided a stacker on which a recording medium discharged from an outlet of a recoding apparatus is placed, which is movable between a first position for closing the outlet and a second position for opening the outlet, the stacker comprising a sheet receiving face, that receives the discharged recording medium, being a first form when the stacker is placed in the first position, and being a second form when the stacker is placed in the second position.

In this configuration, there increased a degree of freedom of the combinations of the discharged sheet stacker and the external configurations of the recording apparatus. As a result, it is easy to develop the products based on a product concept, regardless of the configuration of the discharged sheet stacker.

Preferably, the sheet receiving face is made of a material having flexibility. In this case, the sheet receiving face is relatively freely deformed to have a predetermined configuration when the stacker is placed in the first position. As a result, a compact stacker closed state is realized.

Preferably, the second form of the sheet receiving sheet is substantially flat. In this case the discharged recording medium is supported on the sheet receiving face without any deformation.

Preferably, a center portion of the sheet receiving face is bent downward from both side portions thereof with regard to a widthwise direction of the sheet. When the recording media are stacked on the discharged sheet stacker, a load acting on the discharged sheet stacker increases. However, in this configuration, the bending of the discharged sheet stacker in the sheet discharging direction due to the load can be almost eliminated. A degree of the bending varies depending on a material and size of the sheet receiving face, and hence it cannot be uniquely determined.

Here, it is preferable that the whole part of the stacker forming the sheet receiving face is bent. In this case, the bending state of the stacker can be realized without using another auxiliary member. In this respect, this embodiment is economical.

Also, it is preferable that the stacker further comprises a holder, that supports an upstream end portion of the sheet receiving face with regard to a sheet discharging direction, the holder provided with a support face which is convex downward. The center portion of the sheet receiving face is bent along the support face of the holder.

In this configuration, the upstream portion of the sheet receiving face is forcibly bent downward, its bending state is extended to a downstream portion of the sheet receiving face, thereby preventing the discharged sheet stacker from being bent over its entire length of the sheet receiving face as viewed in the sheet discharging direction. Further, since there is no need of additionally providing a member for retaining the bending state, the sheet receiving face can be bent a simple structure and economically.

Here, it is preferable that the center portion of the sheet receiving face is urged against the support face. In this case, the sheet receiving face is uniformly bent in the width direction by merely urging the central part of the upstream portion of the sheet receiving face against the support face. Further, the bending state of the sheet receiving face can be readily realized.

Alternatively, the stacker further comprises flatness retainers, that retain flatness of the sheet receiving face when the stacker is placed in the second position, the flatness retainers being provided on both side end portions of the sheet receiving face with regard to a widthwise direction of the sheet.

In this configuration, it is easy to remove the deforming tendency of the stacker which was bent when the stacker is closed. Additionally, it further lessens the bending of the stacker by the weight of media stacked on the stacker.

Here, it is preferable that both side end portions of the stacker forming the sheet receiving face are bent in a direction perpendicular to the sheet receiving face to realize the flatness retainers. In this configuration, the flatness retainer also serves as a guide for both side ends of the discharged recording medium. When the stacker is moved from the first position to the second position, it may be ready for use easily and quickly by merely bending the flatness retainers.

Preferably, the sheet receiving face is so deformed as to be along with an outer peripheral shape of a housing of the recording apparatus, when the stacker is placed in the first position. In this case, the outer configuration of the housing may variously be changed in design. The stacker may be designed in good harmony with the whole recording apparatus when it is closed.

Here, it is preferable that the outer peripheral shape of the housing is curved face. In this case, it is possible to provide a recording apparatus having "soft impression", and the products satisfying recent user's needs.

Also, it is preferable that the sheet receiving face is provided with a non-opaque part. In this case, the user can visually recognize a design of the housing through the stacker, even in the closed position, if the sheet receiving face is colored and translucent, the sheet receiving face itself produces a design effect. When the sheet receiving face is combined with a color of the housing, another color is produced. When it is harmonized with the design of the housing, the resultant product may be used as an interior article in an office or home. When the sheet receiving faces having a variety of colors are provided, the user may select a recording apparatus having the color well matching the color of the room. This will yield additional market needs.

Preferably, the sheet receiving face covers at least the outlet when the stacker is placed in the first position. In this case, the stacker may cover the inlet, the outlet or the like, which are formed in the housing, thereby preventing foreign matter from entering those openings when the discharged sheet stacker is no in use. Further, since the outlet and the like are kept from sight, the design value of the whole recording apparatus is improved.

Preferably, the stacker further comprises a holder, that supports an upstream end portion of the sheet receiving face with regard to a sheet discharging direction. The sheet receiving face is formed with at least one aperture in the upstream end portion. The holder includes at least one retainer engaged with the aperture so as to prevent the sheet receiving face from deforming upward.

In this configuration, the deforming tendency of the stacker is forcibly removed, thereby maintaining a predetermined configuration of the sheet receiving face.

Here, it is preferable that the retainer is integrally formed with the holder. In this case, when the holder is formed, the retainer may also be formed concurrently.

Also, it is preferable that a plurality of apertures are arranged symmetrically with respect to a widthwise center line of the stacker. In this case, the deformation of the stacker may be uniformly lessened on both sides of the center line on the stacker as viewed in the width direction. Therefore, it is possible to maintain a configuration of the sheet receiving face closest to a predetermined one.

Still also, it is preferable that the sheet receiving face is so deformed as to be along with an outer peripheral shape of a housing of the recording apparatus, when the stacker is placed in the first position. Here, it is preferable that the outer peripheral shape of the housing is curved face. Further, it is preferable that a widthwise center line of the stacker is offset from a widthwise center line of the housing so that the sheet receiving face is asymmetrically deformed when the stacker is placed in the first position.

When the stacker is deformed along the outer configuration of the housing, an asymmetric tendency to deform is created in the stacker. However, such a deforming tendency may be corrected through the action of the retainers. Therefore, a design of the recording apparatus can be altered as desired, regardless of the outer configuration of the housing and the positional relationship of the housing to the stacker.

According to the present invention, there is also provided a stacker on which a recording medium discharged from an outlet of a recoding apparatus is placed, which is movable between a first position for closing the outlet and a second position for opening the outlet, the stacker comprising:

a sheet receiving face, that receives the discharged recording medium, made of a material having flexibility, and formed with at least one aperture in an upstream end portion with regard to a sheet discharging direction, and a holder, that supports the upstream end portion of the sheet receiving face, the holder including at least one retainer engaged with the aperture so as to prevent the sheet receiving face from deforming upward.

In this configuration, since the deforming tendency of the stacker is forcibly removed, a predetermined configuration of the sheet receiving face can be maintained.

According to the present invention, there is also provided a recording apparatus comprising the above stacker. In this case, the recorded medium may smoothly be received on the stacker. There is no chance that the discharged medium is jammed at the outlet. Further, there is eliminated troublesome work of rearranging the medium on the stacker. Further, there succeeds in providing a recording apparatus of soft impression which well matches user's life style. Since a design freedom is increased, another type of recording apparatus which is capable of satisfying user's needs may readily be provided to the market.

According to the present invention, there is also provided a recording apparatus comprising:

a main body, including an inlet from which a recording medium is inserted, and an outlet from which the recording medium is discharged; and a stacker, made of a material having flexibility, which envelops at least the outlet of the main body at a first position and which guides the discharged recording medium at a second position.

In this configuration there is no case that dust enters the printer inside through the outlet.

Preferably, the stacker is detachably coupled to the main body. In this case, it is easy to replace the stacker with another stacker.

Preferably, the stacker is provided with a display on a face which is the other side of the face on which the discharged recording medium is placed In this case, the house mark and the effective usage of the printer, and a user friendly display, such as impressive print patterns may appear when the stacker is not used. Therefore, the utility value of the tray and the product value of the printer as well are increased.

Preferably, the main body has a shape so rounded as to protrude in a height direction and a depth direction thereof. In this case, it is roundish as a whole, and it gives the user soft impression.

Preferably, both side faces of the main body are broadened toward the bottom. Each side face of the main body is formed with an incurved portion. In this case, its stability is improved, and it is easily carried.

Preferably, the recording apparatus further comprises a tray, made of a material having flexibility, which covers at least the inlet of the main body at a first position and which guides the recording medium to be inserted into the inlet at a second position. In this case, there is no case that dust enters the printer inside through the inlet.

Here, it is preferable that the tray overlaps with the stacker placed in the first position when the tray is placed in the first position. In this case, the dust protecting effect can be further enhanced.

DETAILED DESCRIPTION OF THE PREFERRED EMBODIMENTS

Preferred embodiments of the present invention will be described with reference to the accompanying drawings.

Figure 1:
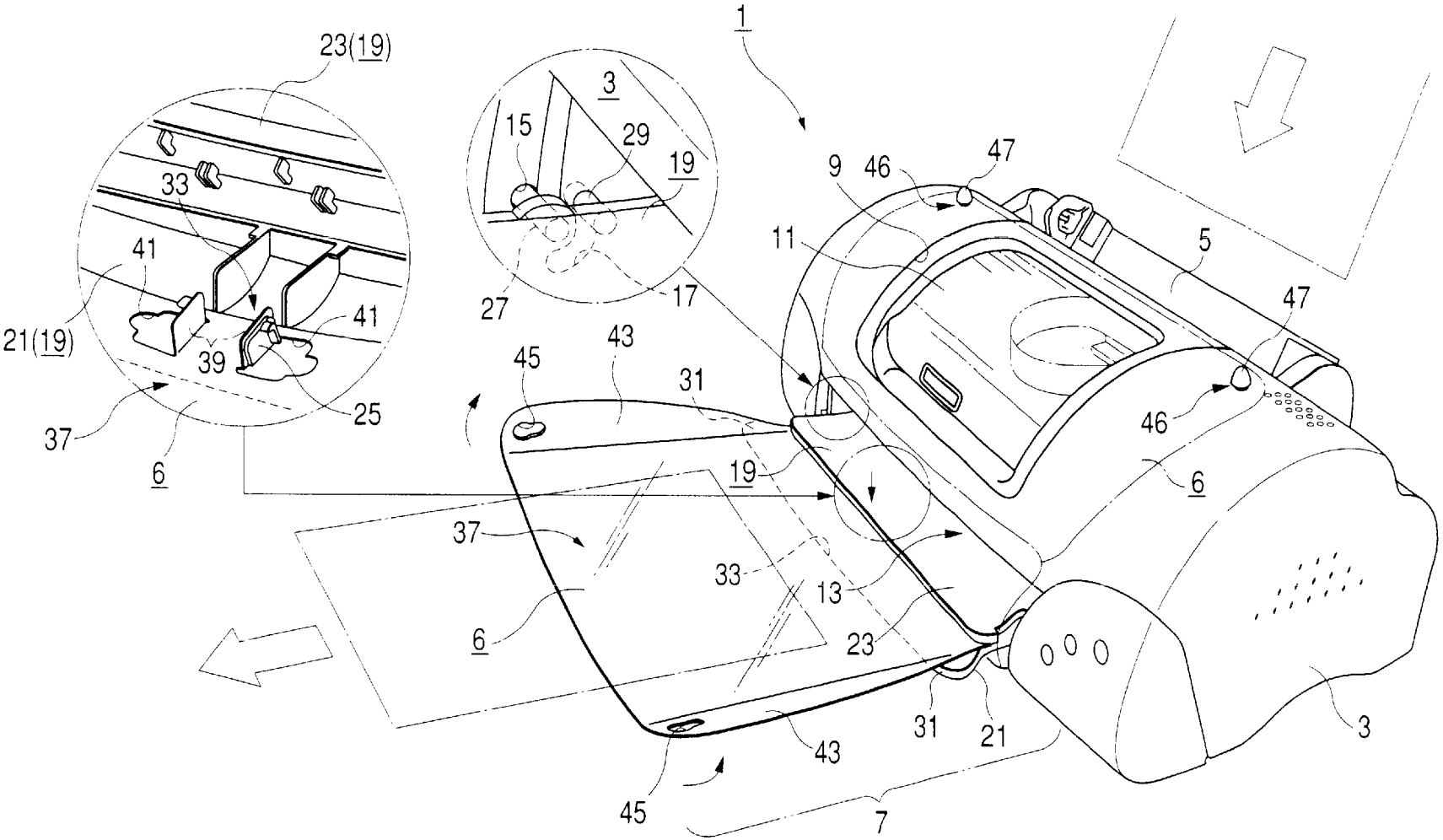
FIG. 1 is a perspective view of a discharged sheet stacker according to a first embodiment of the invention, showing an opened state, inclusive of partial enlarged views.

FIG. 1 shows a printer 1, which is one of a recording apparatus, provided with a discharged sheet stacker according to a first embodiment.

The printer 1 includes a dome-like housing 3 the whole of which is extended in the widthwise direction. A sheet supply section 5 is provided on the rear side of the housing 3. A sheet discharge section 7 having a stacker 6 is provided on the front side of the same. A window 9 is formed ranging from the upper part of the housing 3 to the front thereof. The window 9 is closed with a transparent, curved plastic cover 11 in an openable state. The dome-like printer 1 being extended in the widthwise direction has not existed since difficulty is present in designing the form and structure of the printer when the putting back of the discharged sheet stacker is taken into consideration.

The sheet discharge section 7 includes an outlet 13. As enlargedly illustrated in FIG. 1, a receptacle hole 15 and a guide groove 17 arcuately formed around the receptacle hole 15 are formed at each of both ends of the outlet 13 as viewed horizontally.

Figure 3:
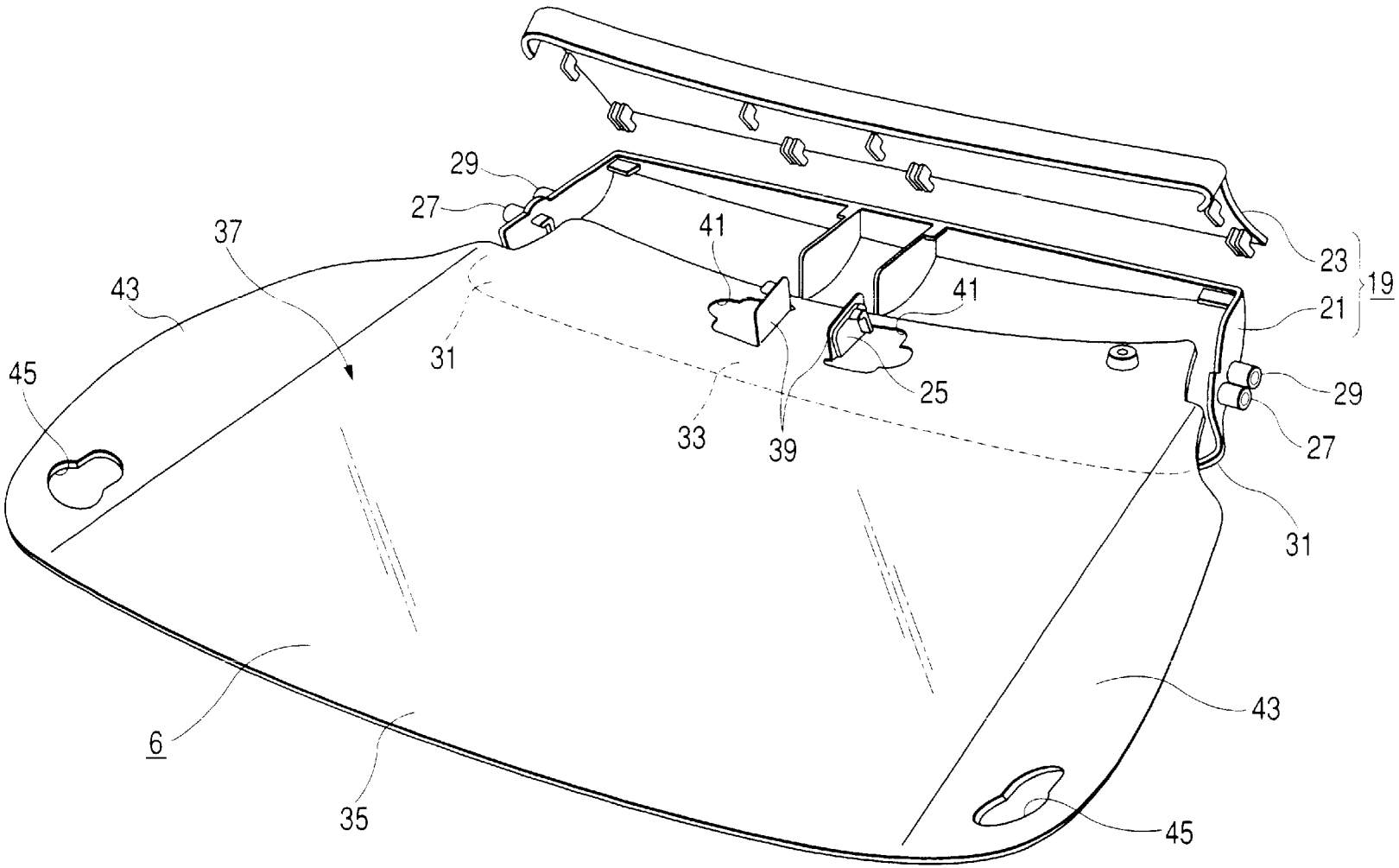
FIG. 3 is a exploded perspective view of the discharged sheet stacker and a holder.

A holder 19 is mounted on the outlet 13 in a state that it may be turned in the vertical direction. As shown in FIG. 3 and enlargedly shown in FIG. 1, the holder 19 consists of a lower holder 21 and an upper holder 23. Two upstanding pieces 25 (best illustrated in FIG. 5) are provided in the central portion of the lower holder 21. Two projections, a shaft projection 27 and a guide projection 29, are provided at both ends of the lower holder 21. The shaft projections 27 are respectively inserted into the receptacle holes 15, and in this state those projections serve as a shaft about which the holder 19 is turned. The guide projections 29 are received by the arcuate guide holes 17, respectively, and guide the turning of the holder 19.

The lower holder 21 is extended to the sheet discharge direction, to thereby form an extended supporter 31. The lower holder 21 including the extended supporter 31 is somewhat bent downward as a whole, whereby a concave portion 33 is formed. Functional operations of the extended supporter 31 and the concave portion 33 will be described later.

Figure 4A:
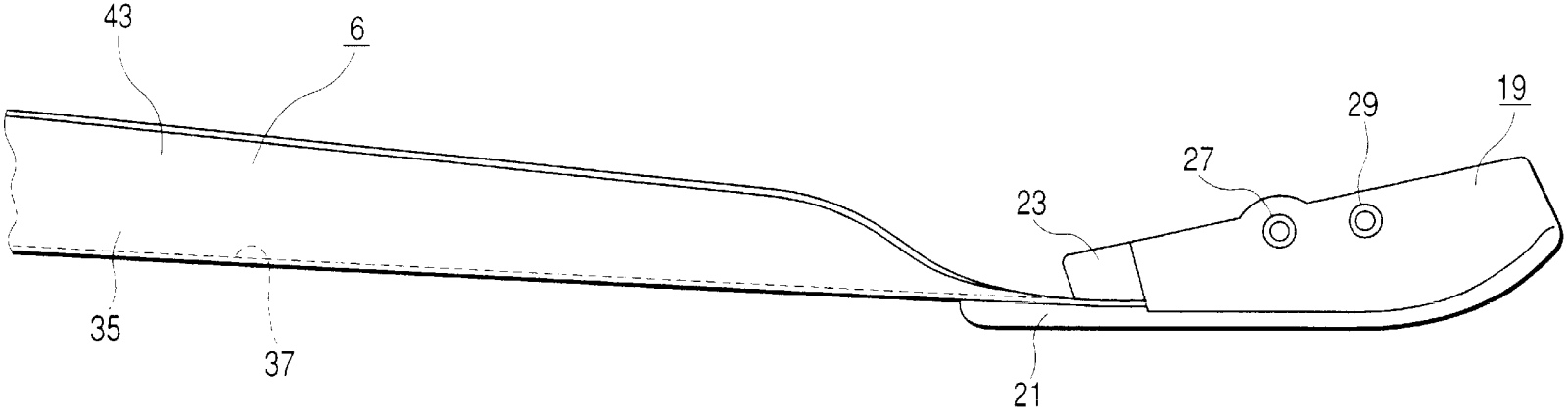
FIG. 4A is a side view showing the discharged sheet stacker and the holder.
Figure 4B:
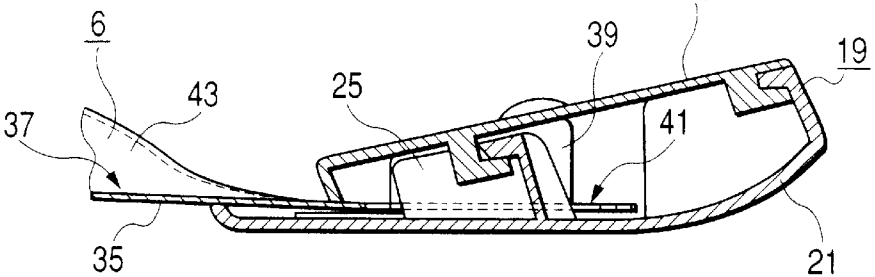
FIG. 4B is a partial section view of FIG. 4A.

As shown in FIGS. 4A and 4B, the stacker 6 is supported between the upper holder 23 and the lower holder 21. The stacker 6 is formed by bending a flexible plastic sheet 35. The upper face of the plastic sheet 35 serves as a sheet receiving face 37 on which sheets discharged from the outlet 13 are stacked one upon the other. Upstanding parts of the plastic sheet 35 which are made by forming cutouts 41, supported pieces 39 are formed at positions corresponding to the upstanding pieces 25 on the base side (the upstream side thereof as viewed in the sheet discharging direction) of the stacker 6.

As shown in FIG. 3, the cutouts 41 receive the two upstanding pieces 25 of the lower holder 21, respectively.

The supported pieces 39 are placed in the two upstanding pieces 25 in a fitting fashion, whereby the stacker 6 is positioned. In this state, the upper holder 23 is combined with the lower holder 21, and the stacker 6 is supported by the holder 19.

Figure 5:
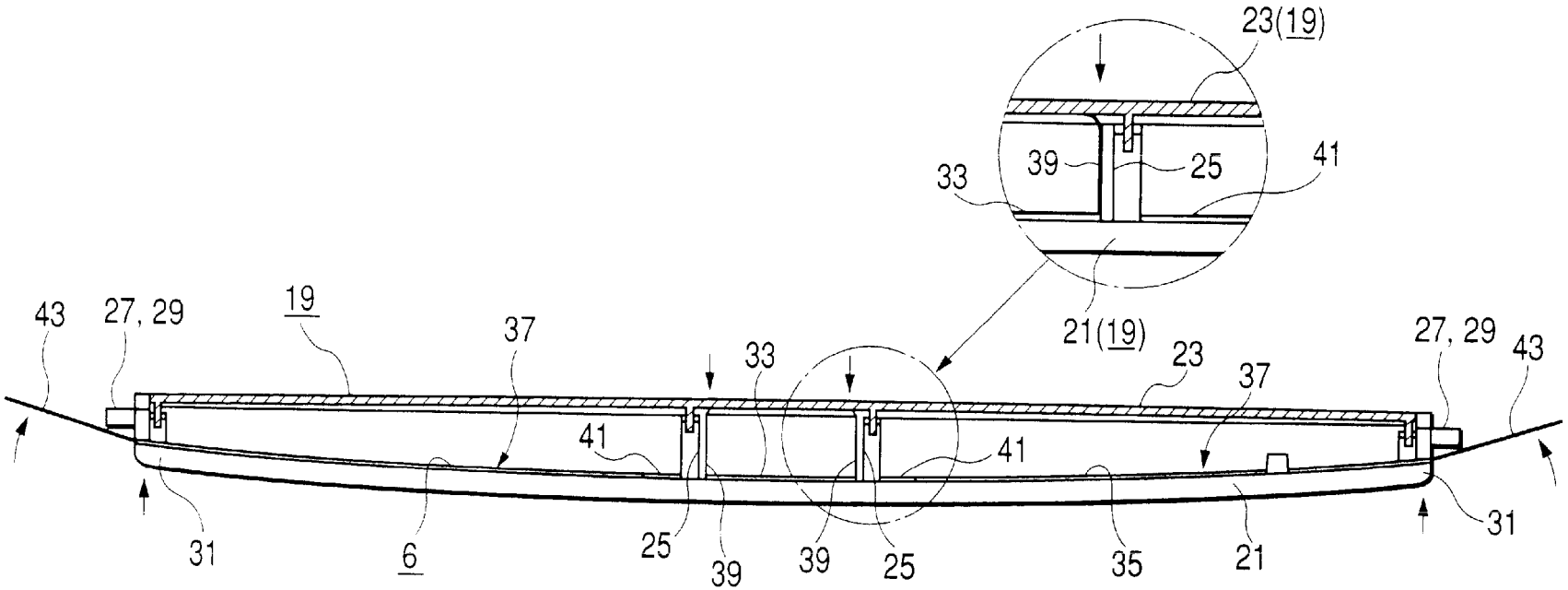
FIG. 5 is a rear elevation, partly broken, showing a discharged sheet stacker, inclusive of an enlarged view.

When as shown in FIG. 4B, the supported pieces 39 of the stacker 6 are positioned between the upstanding pieces 25, the upper part of the supported piece 39 is located somewhat above the upper part of the upstanding pieces 25. When in this state, the upper holder 23 is coupled to the lower holder 21, the lower side of the upper holder 23, as shown in FIG. 5, pushes downward the protruded parts of the supported pieces 39, thereby to forcibly deform the stacker 6 along a configuration of the concave portion 33.

Thus, by forcibly bending the base end of the plastic sheet 35 forming the stacker 6, the center of the sheet receiving face 37 as viewed in the sheet width direction is somewhat bent downward from both sides of the sheet receiving face, while extending in the sheet discharging direction. Accordingly, even if a plurality of sheets are placed on the stacker 6, it is hardly bent downward and in the sheet discharging direction. The wording "somewhat bending" means 2 state that the stacker is hardly deformed, by its bending, out of its perfect flat shape when it is put under a load of the sheets placed thereon, while keeping a basic flat shape of the stacker. In other words, the "somewhat bending" means a bending of the stacker which is approximate to "flatness". A degree of the bending varies depending on a material and size of the sheet receiving face, and hence it cannot be uniquely determined.

Bending portions 43 serving as a flatness retainer are provided on both ends of the sheet receiving face 37 as viewed in the sheet width direction. In the illustrated instance, the bending portions 43 are formed by bending the plastic sheet 35 upward, if required, it may be formed by bending the plastic sheet downward, obliquely upward or downward, or curling the plastic sheet. The bending portions 43 are bent only when the stacker 6 is used. When the stacker 6 is closed, it may be flush with the sheet receiving face 37.

Since the bending portions 43 are bent when the discharged sheet stacker is used, the following advantages are produced. A tendency to curve the sheet receiving face 37 which has curved in putting back the stacker is easy to be removed, and the flat face of the stacker on which the sheets are placed is formed and retained. There is substantially completely eliminated the bending of the stacker 6 in the sheet discharging direction by the weight of the stacked sheets when sheets are stacked on the stacker 6. Additionally, both ends of the plastic sheet 35 are naturally bent when the stacker 6 being in a closed state is put to an opened state. Accordingly, the stacker 6 may be readily and quickly set to the opened state.

While the flatness retainer takes the form of the bending portions 43 in the embodiment, it may be realized such that long and narrow members of good rigidity are attached to both ends of the plastic sheet 35 when the stacker is used.

Engagement holes 45 are formed on both side ends of the front end of the stacker 6. When the stacker 6 is closed, the engagement holes 45 are respectively engaged with projections 47 which are provided on both ends of the upper face of the housing 3, whereby the stacker is immovably put in its place.

As shown in FIG. 3, each of the engagement holes 45 consists of two large and small holes that partly overlap with each other. Each of the projections 47 includes a neck portion 46 located at its lower part. Each projection 47 is first inserted through the associated large-hole part of engagement hole 45. The stacker 6 is somewhat naturally deformed by its restoring force to its original form, and each small-hole part fits with the neck portion 46 of the projection 47. The engagement holes 45 do not come out of the projections 47 in a natural state.

The plastic sheet 35 of the stacker 6 is colored and translucent. Accordingly, when the stacker 6 is closed, one can see the housing 3 through the plastic sheet 35. A color of the plastic sheet 35 may be selected appropriately. The plastic sheet may be transparent, translucent or opaque. A color and pattern of the plastic sheet may appropriately be selected in consideration of a harmonization of the color and pattern of the plastic sheet 35 with those of the housing 3.

The opened state and the closed state of the stacker 6, and the configuration-retaining structure when the discharged sheet stacker is in use will be described. FIG. 1 shows a state of the stacker 6 not having the tendency to deform when it is used. In FIG. 1, a state of the stacker 6 when it is closed is also illustrated by use of a phantom line for ease of explanation. As shown in FIG. 1, when the stacker is in use, the sheet receiving face 37 is substantially flat. Although not clearly shown in FIG. 1, the base end of the sheet receiving face 37, as shown in FIG. 5, is pressed against the concave portion 33, so that the central portion of the sheet receiving face 37 is somewhat bent downward. Both sides of the stacker 6 are bent upward, whereby a rigidity of the stacker 6 is increased in the sheet discharging direction.

When in this state, printed sheets are successively discharged from the outlet 13, those sheets are progressively stacked on the stacker 6. At this time, the weight of the stacked sheets acts on the stacker 6. However, the stacker 6 supports the stacked sheets while not bent in the middle of its extension to the sheet discharging direction since the central portion of the sheet receiving face 37 is somewhat bent downward and the bending portions 43 at both sides of the sheet receiving face are bent upward. Also with provision of the extended supporter 31 on the lower holder 21, the bending of the stacker 6 is suppressed.

Figure 2:
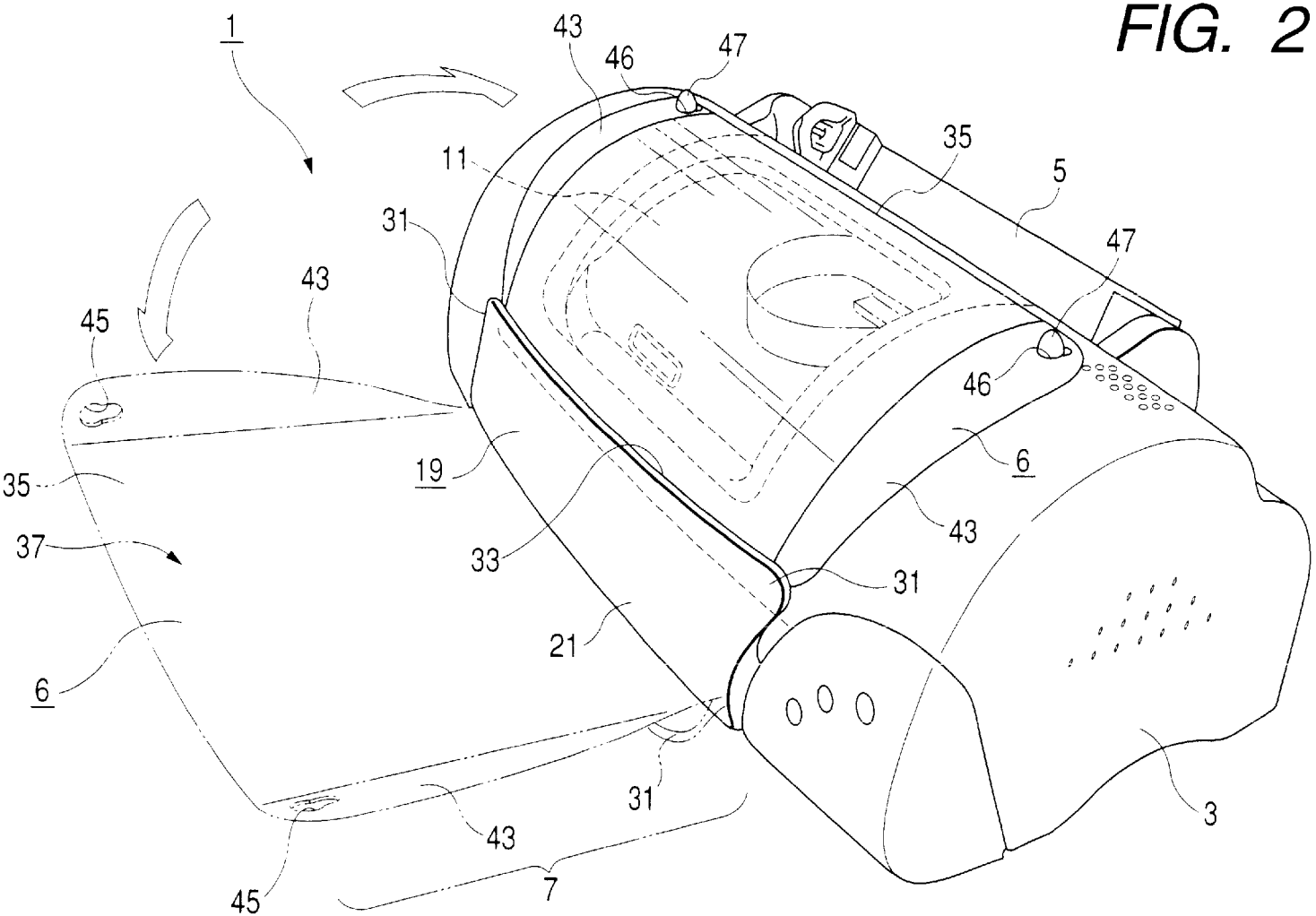
FIG. 2 is a perspective view of the discharged sheet stacker, showing a closed state.

FIG. 2 shows a state of the stacker 6 when it is closed in FIG. 2, a state of the stacker 6 when it is in use is also illustrated by using a phantom line. As shown in FIG. 2, to closed the stacker 6 in its place, the bending of the bending portions 43 of both sides of the stacker 6 is removed (viz., the whole of the discharged sheet stacker is flat), the holder 19 is turned upward, and the stacker 6 is pressed against the housing 3 to be curved along the curved face of the housing 3. By putting, in this state, the engagement holes 45 of the stacker 6 into engagement with the neck portions 46 in the lower parts of the projections 47, the stacker 6 is placed to a closed state, while the stacker 6 is curved along the curved face of the housing 3.

Thus, in the present invention, the form of the stacker 6 when it is in a opened state is different from that when it is in a closed state. Accordingly, the form of the discharged sheet stacker less affects the design of fashioning the housing 3, whereas the former greatly affects the latter in the related stacker. In this respect, a high design freedom is secured in designing products.

The sheet receiving face 37 is deformable along the form of the housing 3 when it is closed in its place. Accordingly, it covers the outlet 13 and other portions, which are formed in the housing 3. With the coverage by it, no foreign matters enter the printer inside through the outlet 13.

Next, a recording apparatus according to a second embodiment will be described with reference to FIGS. 6 through 10. In this embodiment, there is provided a structure to retaining a configuration of a discharged sheet stacker. Same reference numerals are assigned to members identical with the first embodiment, and detailed explanations will be omitted.

Figure 6:
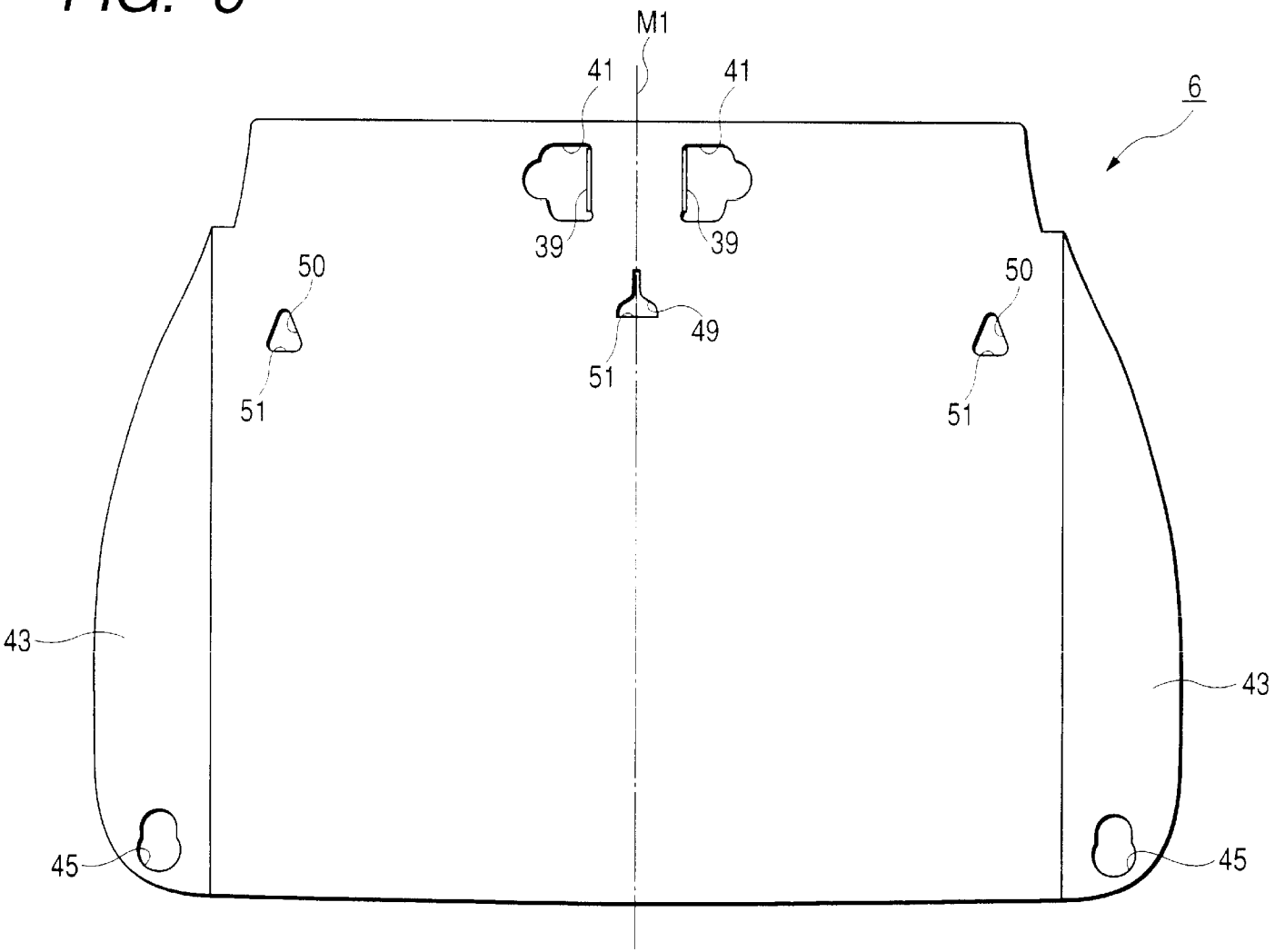
FIG. 6 is a plan view of a discharged sheet stacker according to a second embodiment of the invention.

As shown in FIG. 6, three apertures 49, 50, are formed in the region of the base end of the discharged sheet stacker 6. The aperture 49 lies on a center line M1 of the stacker 6 as viewed in the width direction. The remaining two apertures 50 are formed at positions which are symmetrical with respect to the center line Ml of the stacker 6 as viewed in the width direction, viz., positions located just inside the bending portions 43. Each of the apertures 49, 50 includes a straight side 51, which is formed at its position located on the front end side of the stacker 6, and the base end of the aperture is arcuately configured.

Figure 7:
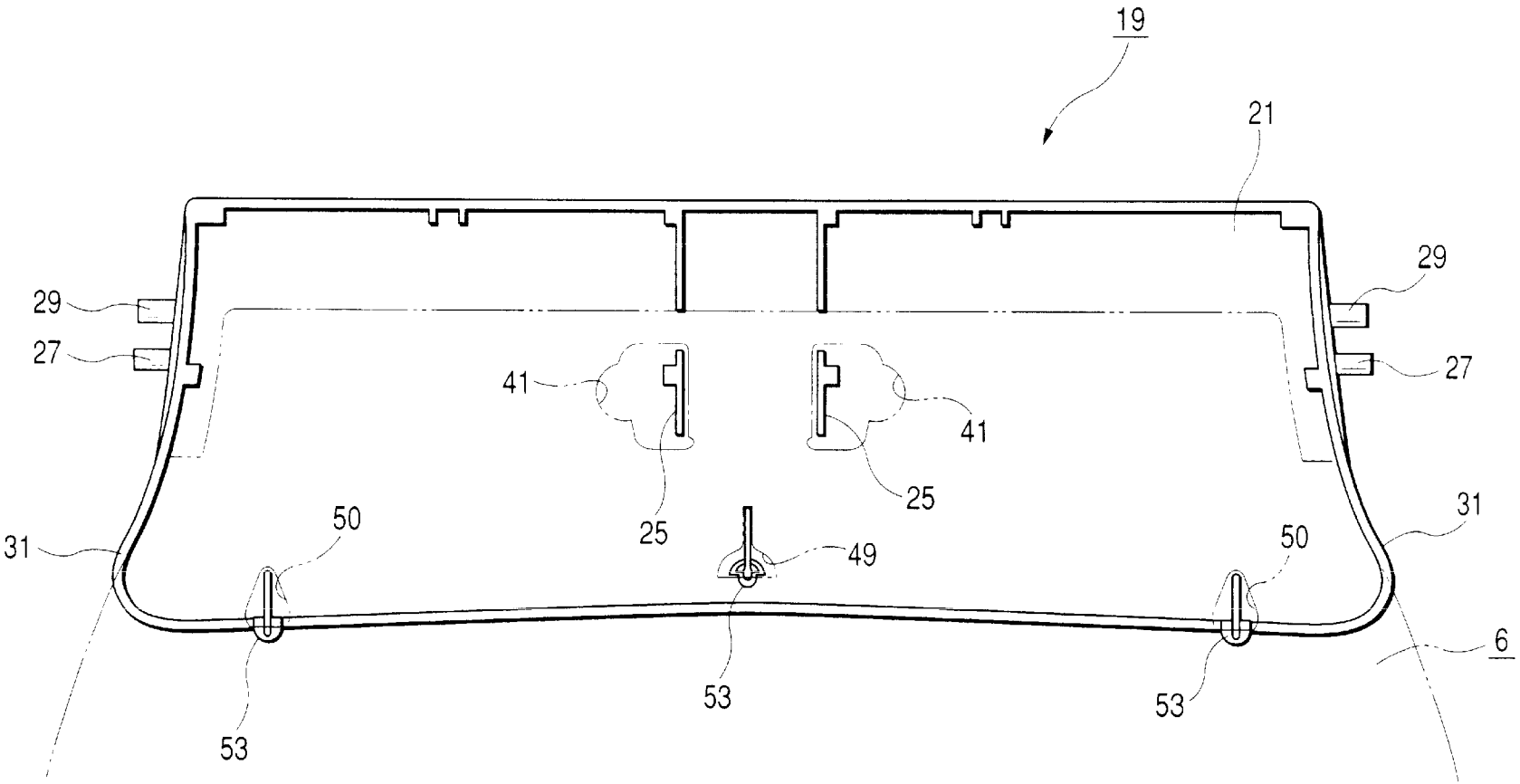
FIG. 7 is a plan view of a holder for the discharged sheet stacker shown in FIG. 6.
Figure 9A:
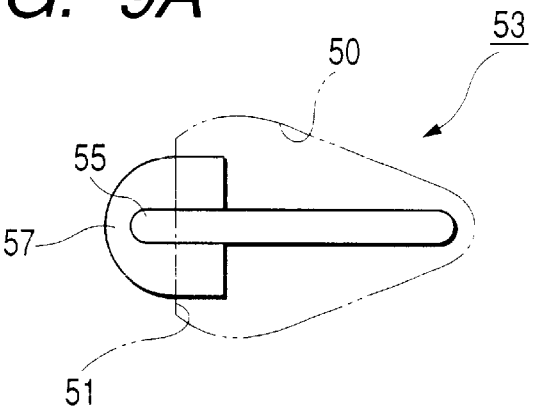
FIGS. 8A and 9A are enlarged plan views showing retainers provided with the holder shown in FIG. 7.
Figure 9B:
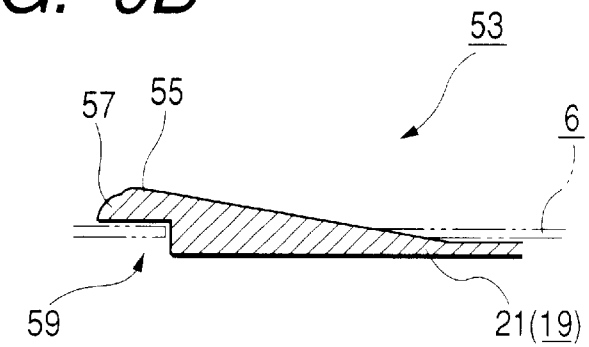
FIGS. 8B and 9B are enlarged section views showing the retainers.
Figure 8A:
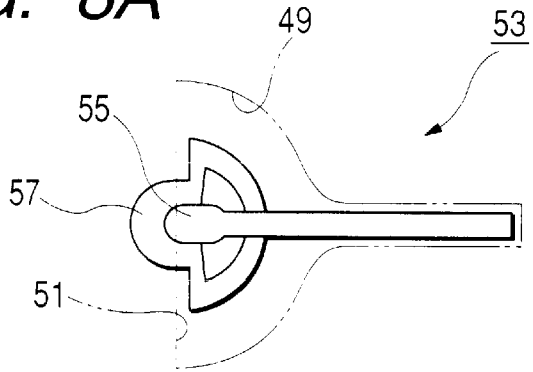
Figure 8B:
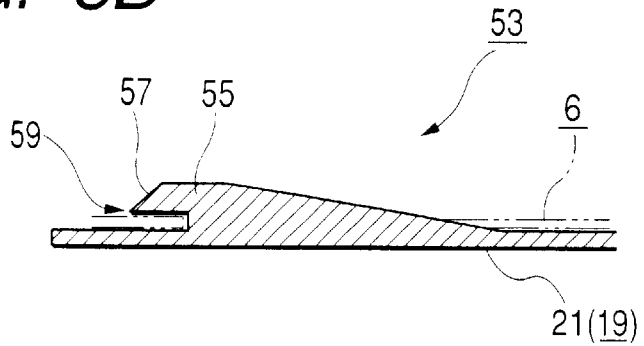
Figure 10:
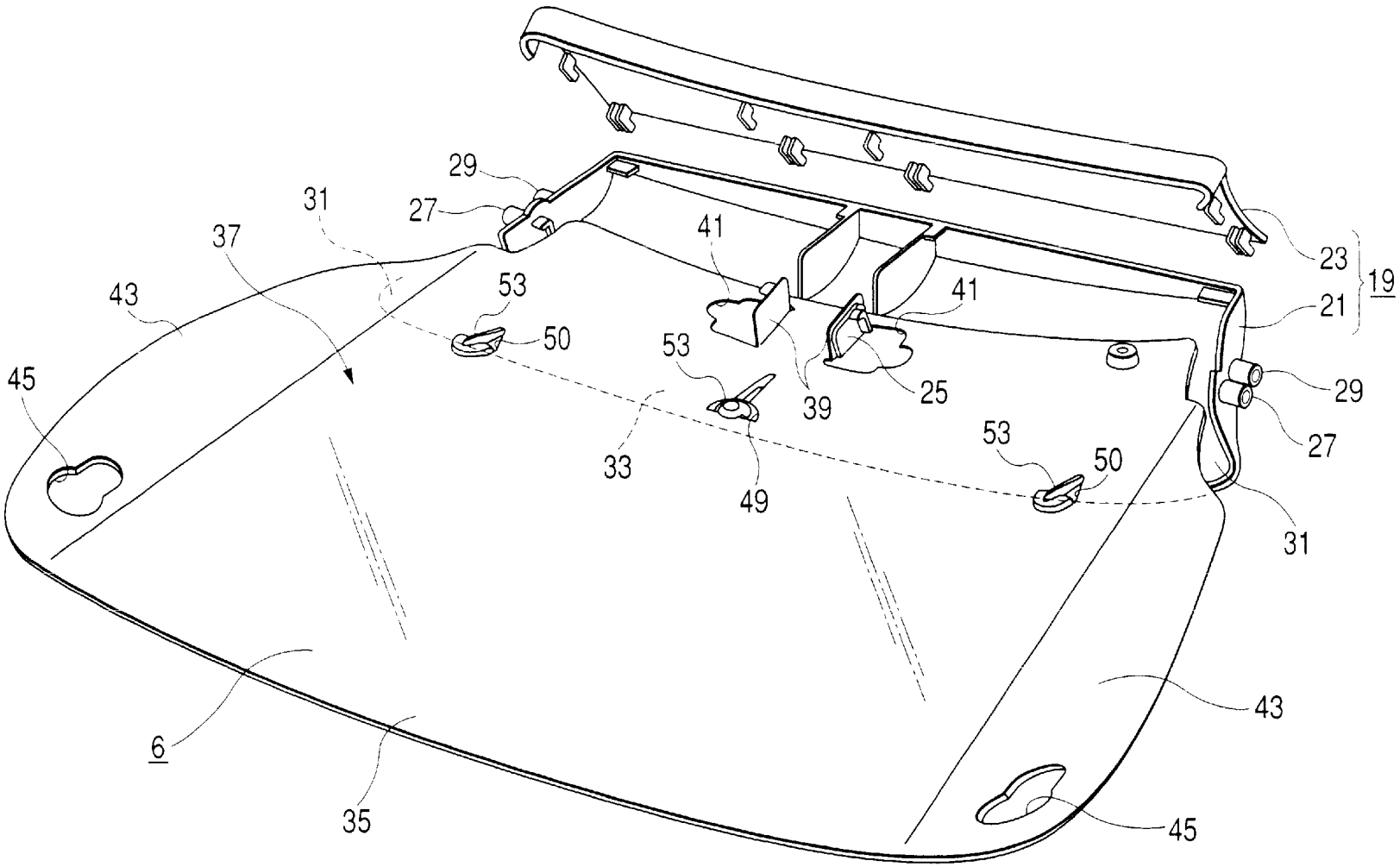
FIG. 10 is an exploded perspective view of the discharged sheet stacker and the holder of the second embodiment.

On the other hand, as shown in FIG. 7, retainers 53 are formed, while being integral with the holder 19, near the front end of the holder 19 at positions corresponding to the apertures 49, 50. Each of the retainers 53, as enlargedly illustrated in FIGS. 8A, 8B, 9A and 9B, includes a protruded part 55 and a retaining piece 57 that is extended from the protruded part 55 forward (to the downstream side as viewed in the sheet forwarding direction). A slit 59, which may receive the straight side 51, is formed in the lower part of the retaining piece 57. Each retainer 53 has a smooth oblique face which is slanted toward the upstream side in the sheet forwarding direction. A sheet of paper moves on and along the smooth oblique face of the retainers 53, and may move over retainers 53.

It is preferable that the apertures 49, 50, and the retainers 53 provided in association with those holes are provided symmetrically with respect to the center line M1 of the stacker 6 as viewed in the width direction. In this case, the number and the locations of those holes and the retainers are not limited in particular. If the retainers 53 are provided on the front end of the holder 19 and at locations closer to both ends of the holder 19, the deformation of the stacker 6 having the tendency to deform will effectively be corrected.

Figure 11:
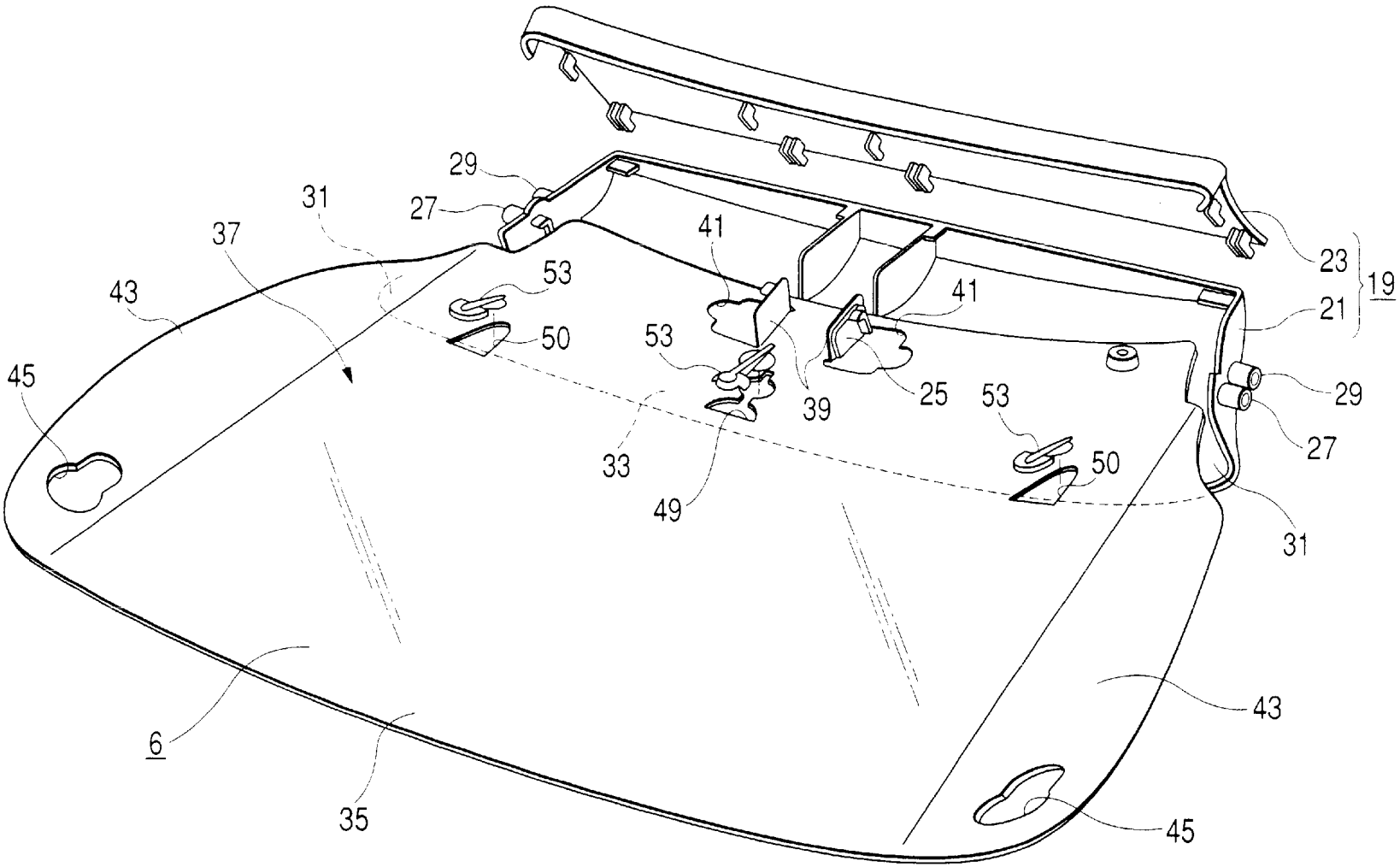
FIG. 11 is an exploded perspective view of the discharged sheet stacker and the holder according to a third embodiment of the invention.

In the embodiment shown in FIGS. 7 through 10, the retainers 53 are integral with the holder 19. In a recording apparatus according to a third embodiment of the invention, the retainers 53 and the holder 19 may be formed separated from each other, as shown in FIG. 11. In this case, when the stacker 6 has the tendency to deform, the retainers 53 are bonded to the holder 19 by adhesive or the like.

Figure 12:
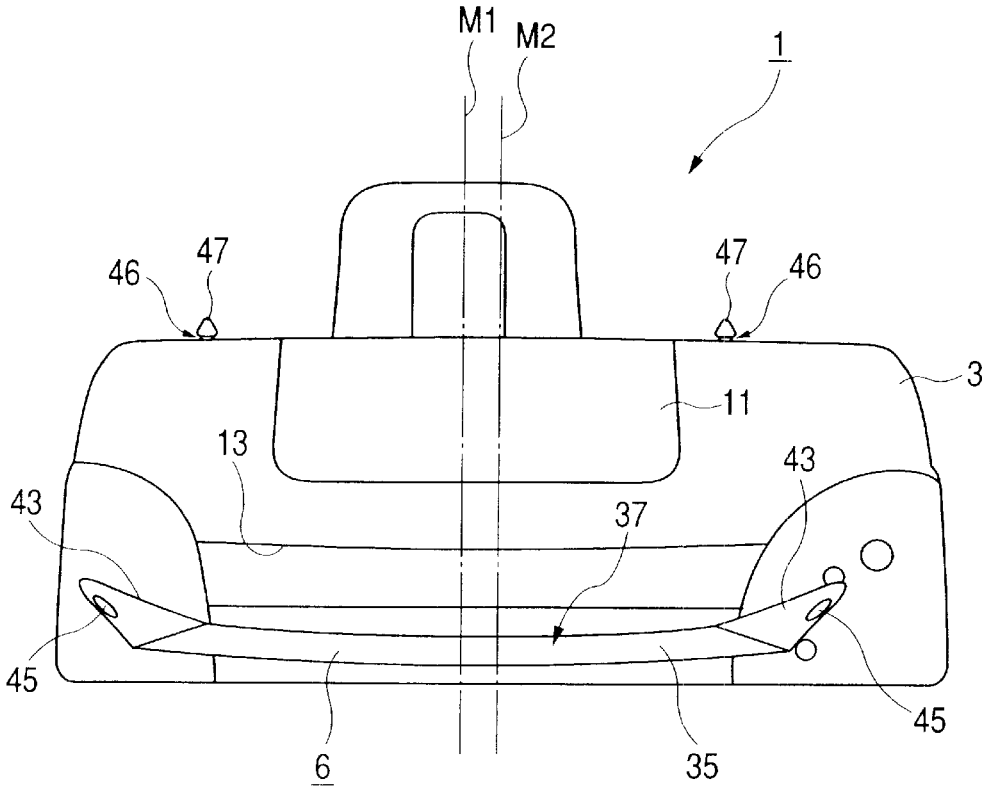
FIG. 12 is an illustration showing a state that a housing center is not coincident with the center of the discharged sheet stacker.

Regarding the second and third embodiments, the structure which retains the form of the discharged sheet stacker when the stacker is in use will be described. The flexible stacker 6 is deformable along the shape of the housing 3. Accordingly, when the stacker 6 is opened for its use, sometimes the stacker has had the tendency to deform. As shown in FIG. 12, a standby position (not shown) of a carriage with an ink cartridge mounted thereon is located in a right portion within the housing 3. Because of this, the center line M2 of the housing 3 is not coincident with the center line M1 (coincident with the center line of the outlet 13 through which the sheet of paper is discharge) of the stacker 6 as viewed in the width direction. Accordingly, when the stacker 6 is closed while being deformed along the configuration of the housing 3, the stacker 6 deformed is asymmetrical with respect to its center line. Accordingly, it is closed in a state that it is deformed to be asymmetrical with respect to its center.

Figure 13:
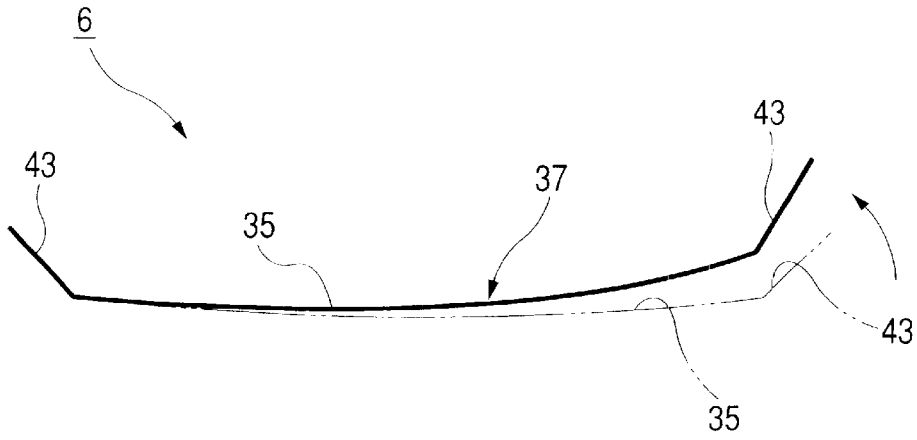
FIG. 13 is an illustration showing the discharged sheet stacker having the tendency to deform.

After the discharged sheet stacker is left deformed for a long time, when the stacker 6 is opened for its use, the stacker 6 has had the tendency to asymmetrically deform, and hence the right or left side of the stacker 6 is raised as shown in FIG. 13.

Even in such a case, since the straight sides 51 of the apertures 49 and 50 are inserted in the slits 59 of the retainers 53 as shown in FIGS. 7 to 10, the portion of the stacker 6 which tends to rise is put within the slit 59, and hence prevented from being deformed upward. Accordingly, the stacker is forcibly restored to its original configuration as shown in FIG. 1.

Figure 14:
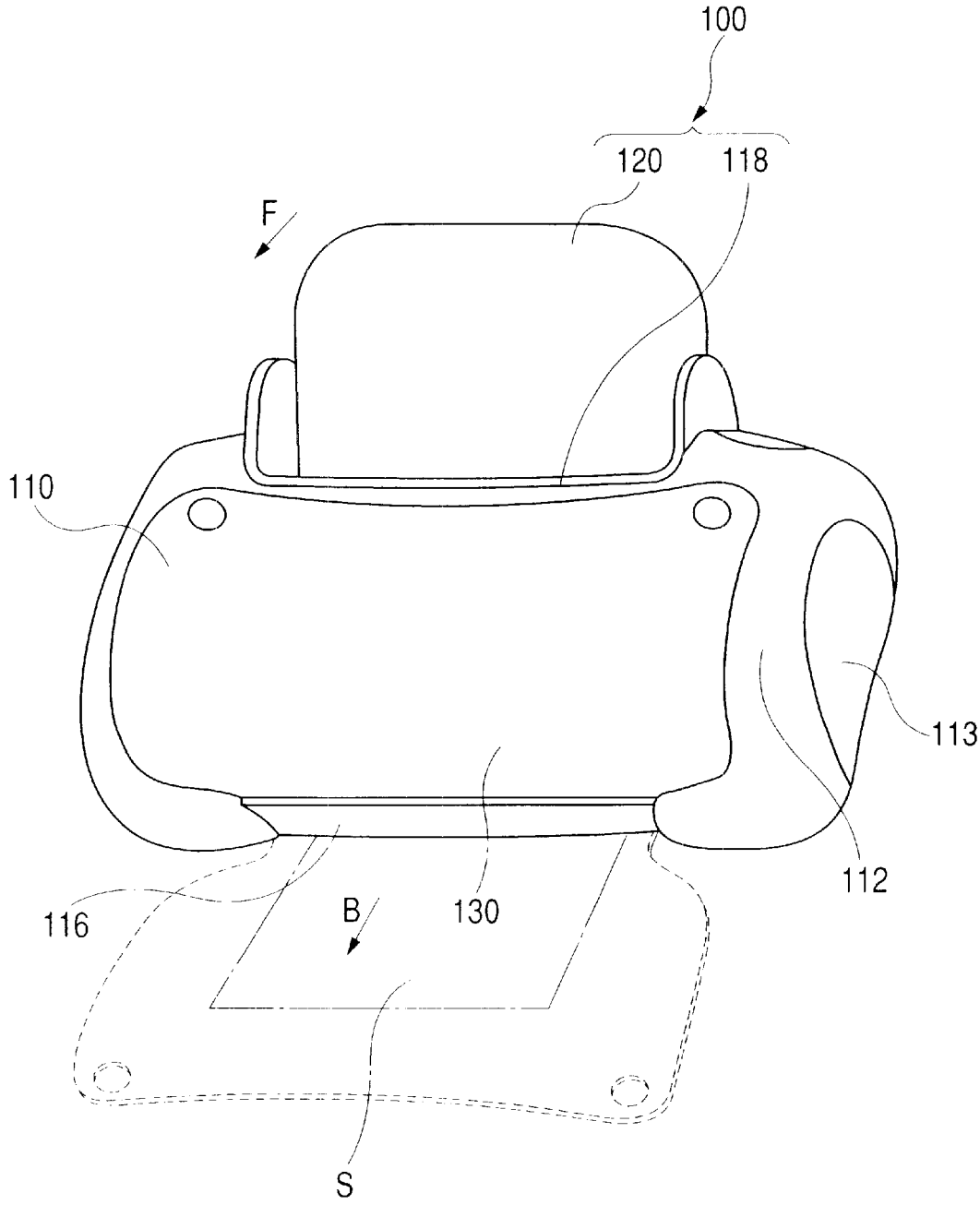
FIG. 14 is a perspective view showing a recording apparatus according to a fourth embodiment of the invention.

Next, a recording apparatus according to a fourth embodiment of the invention will be described with reference to FIGS. 14 to 18. An overall configuration of an ink jet printer 100, which is one example of the recording apparatus, is shown in FIG. 14. The printer 100 contains therein mechanisms for supplying sheets of paper, printing thereon, and discharging the sheets after the printing. An external appearance of the printer 100 is configured like a stuffed toy animal, or the deformed head of an animal (e.g., hippopotamus) or an insect (e.g., dragonfly).

Specifically, a discharged sheet stacker 130, which is shaped like an ear or a wing of an animal, is detachably attached to an attractive, rounded, dumpy shape of main body 110 such that the stacker may be raised and opened, and closed in its place. In use, a recording sheet is supplied from a sheet supply tray 120 located on the rear side (in the direction of an arrow F), and the printed recording sheet is discharged onto the stacker 130 (in the direction of an arrow B) as if an animal sticks out its tongue. When the printer is not in use, the tray 120 and the stacker 130 are placed enveloping the outer face of the main body 110 with them as if a mother bird holds her baby bird in her wings for protecting the baby bird against the enemy.

When the printer thus constructed and fashioned is placed in an office, it is friendly to users. It attracts the interest of the persons of lower age in particular. Accordingly, it has the added value and it is increased in customer attraction.

Figure 15:
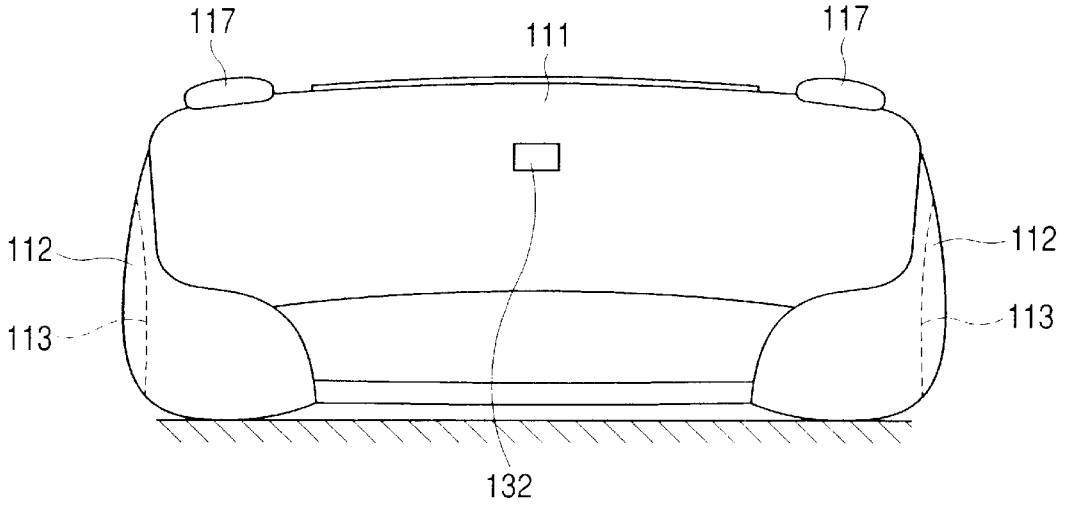
FIG. 15 is a front view of the recording apparatus shown in FIG. 14.
Figure 16:
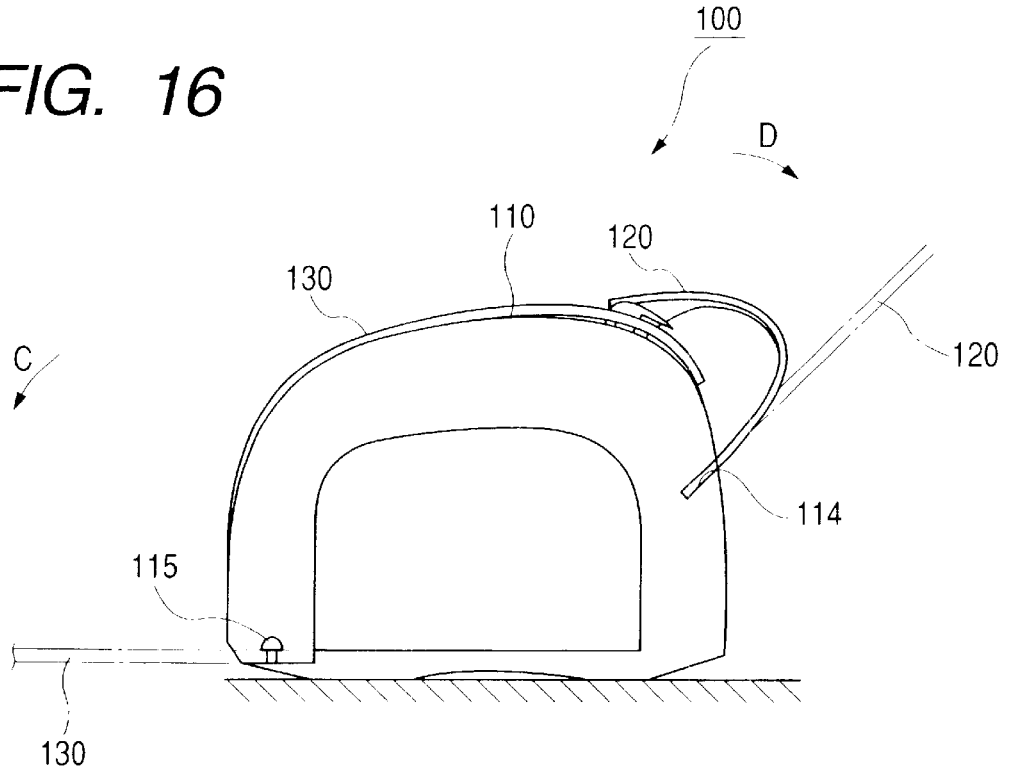
FIG. 16 is a side view of the recording apparatus shown in FIG. 14.
Figure 17:
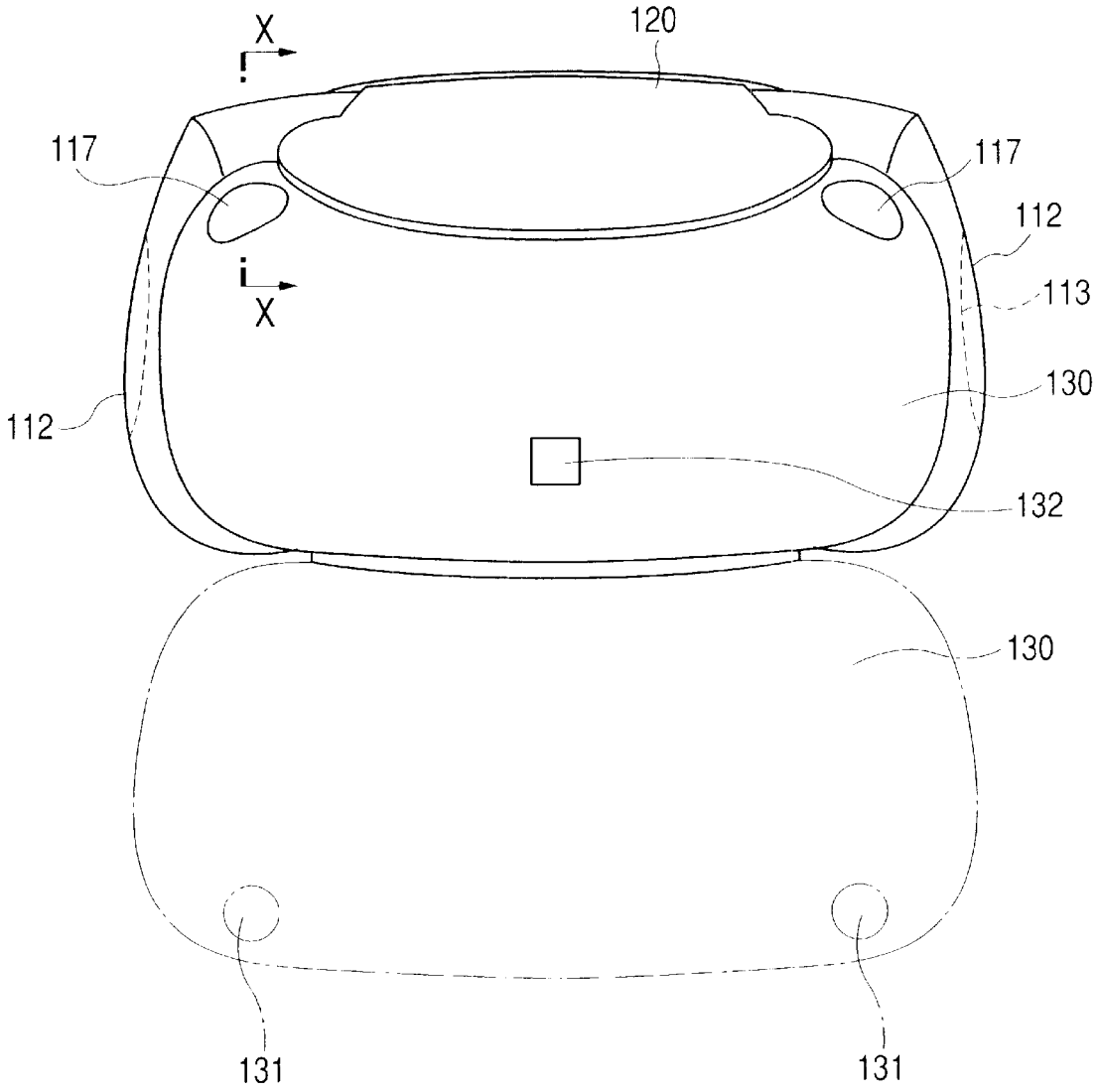
FIG. 17 is a top plan view of the recording apparatus shown in FIG. 14.
Figure 18:
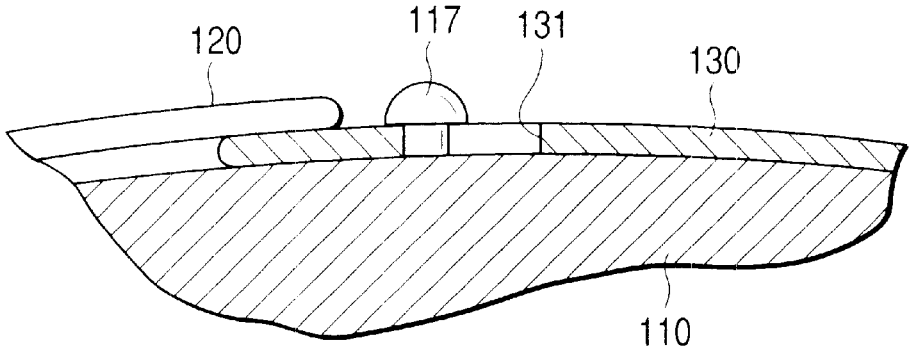
FIG. 18 is a cross sectional view taken along line X—X in FIG. 17.
Figure 19:
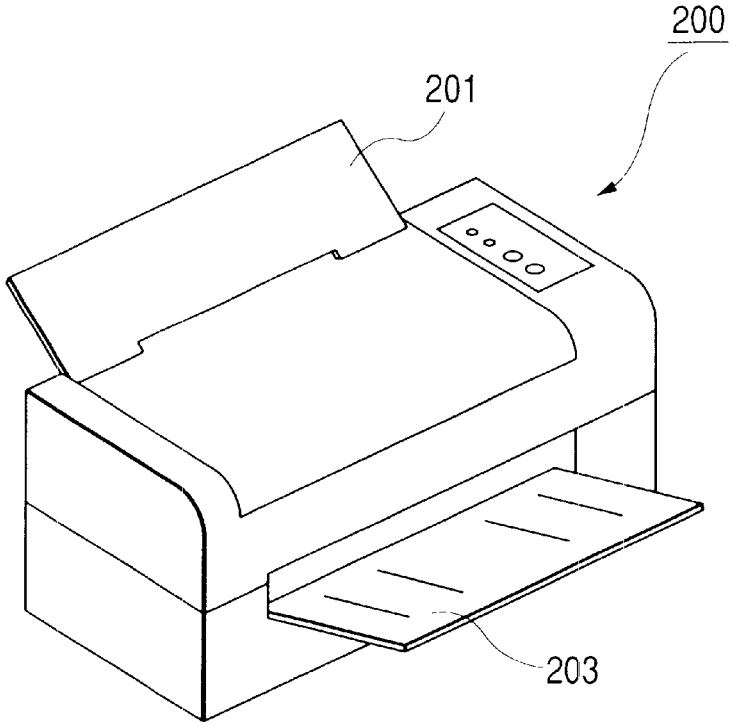
FIG. 19 is a perspective view showing a related recording apparatus.

As shown in FIGS. 15 to 17, the main body 110 is semicylindrical such that it is elongated in the longitudinal direction and its central part is somewhat higher than the remaining part. Both side faces 112 are expanded in the longitudinal direction and broaden toward the bottom. Accordingly, it is stably placed without any danger of its overturn.

Gently incurved portions 113 are formed in the side faces 112, respectively. In carrying the printer, if the user puts his fingers to those incurved portions 113, he can carry the printer easily and without slipping off the printer.

The stacker 130 is made of a flexible material, e.g., translucent plastic, and shaped like a plate. The tray 120, as shown in FIG. 16, is detachably attached to an insertion groove 114 of a sheet inlet 118 of the main body 110. The stacker 130 is removably attached to fixers 115, such as front hooks of the main body 110. When the printer 100 is used, the tray 120 is raised in the direction of an arrow D as indicated by a phantom line in FIG. 16. The stacker 130 is extended to a position in front of the printer 100 as indicated by an arrowhead C. A recording sheet S on the tray 120 is fed and printed, and then the printed sheet is discharged onto the stacker 130.

When the printer 100 is not in use, the stacker 130, while being curved, is raised in the reverse direction to the direction of the arrowhead C, and covers the sheet discharging opening 116 and the upper face of the main body 110, while enveloping the main body 110. Finally, T-shaped engagement holes 131 are engaged with associated buttons 117 and fixed thereto.

The tray 120 is curved in the opposite direction to the direction of the arrow D to close the sheet inlet 118. As a result, the tray 120 and the stacker 130 are disposed as if those hold the main body 110 tightly, thereby protecting the printer against dust.

The house mark and the effective usage of the printer 100, and a user friendly display section 132, such as impressive print patterns may be provided on the rear side of the stacker 130 which is located outside when it is not used. As a result, the utility value of the tray and the product value of the printer as well are increased.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A stacker attached to a recording apparatus having an outlet, the recording medium discharged from the outlet of the recoding apparatus being placed on the stacker, the stacker being movable between a first position for closing the outlet and a second position for opening the outlet, the stacker comprising a sheet receiving face, that receives the discharged recording medium, being a first form when the stacker is placed in the first position, and being a second form when the stacker is placed in the second position.

2. The stacker as set forth in claim 1, wherein the sheet receiving face is made of a material having flexibility.

3. The stacker as set forth in claim 1, wherein the second form of the sheet receiving sheet is substantially flat.

4. The stacker as set forth in claim 1, wherein a center portion of the sheet receiving face is bent downward from both side portions thereof with regard to a widthwise direction of the sheet.

5. The stacker as set forth in claim 4, wherein a whole part of the stacker forming the sheet receiving face is bent.

6. The stacker as set forth in claim 4, further comprising a holder, that supports an upstream end portion of the sheet receiving face with regard to a sheet discharging direction, the holder provided with a support face which is convex downward, wherein the center portion of the sheet receiving face is bent along the support face of the holder.

7. The stacker as set forth in claim 6, wherein the center portion of the sheet receiving face is urged against the support face.

8. The stacker as set forth in claim 1, further comprising flatness retainers, that retain flatness of the sheet receiving face when the stacker is placed In the second position, the flatness retainers being provided on both side end portions of the sheet receiving face with regard to a widthwise direction of the sheet.

9. The stacker as set forth in claim 8, wherein both side end portions of the stacker forming the sheet receiving face are bent in a direction perpendicular to the sheet receiving face.

10. The stacker as set forth in claim 1, wherein the sheet receiving face is so deformed as to be along with an outer peripheral shape of a housing of the recording apparatus, when the stacker is placed in the first position.

11. The stacker as set forth in claim 10, wherein the outer peripheral shape of the housing is curved face.

12. The stacker as set forth in claim 10, wherein the sheet receiving face is provided with a non-opaque part.

13. The stacker as set forth in claim 1, wherein the sheet receiving face covers at least the outlet when the stacker is placed in the first position.

14. The stacker as set forth in claim 1, further comprising: a holder, that supports an upstream end portion of the sheet receiving face with regard to a sheet discharging direction, wherein the sheet receiving face is formed with at least one aperture in the upstream end portion; and wherein the holder includes at least one retainer engaged with the aperture so as to prevent the sheet receiving face from deforming upward.

15. The stacker as set forth in claim 14, wherein the retainer is integrally formed with the holder.

16. The stacker as set forth in claim 14, wherein a plurality of apertures are arranged symmetrically with respect to a widthwise center line of the stacker.

17. The stacker as set forth in claim 14, wherein the sheet receiving face is so deformed as to be along with an outer peripheral shape of a housing of the recording apparatus, when the stacker is placed in the first position.

18. The stacker as set forth in claim 17, wherein the outer peripheral shape of the housing is curved face.

19. The stacker as set forth in claim 18, wherein a widthwise center line of the stacker is offset from a widthwise center line of the housing so that the sheet receiving face is asymmetrically deformed when the stacker is placed in the first position.

20. The stacker as set forth in claim 14, wherein the sheet receiving face is provided with a non-opaque part.

21. A recording apparatus comprising the stacker as set forth in claim 14.

22. A recording apparatus comprising the stacker as set forth in claim 1.

23. A stacker on which a recording medium discharged from an outlet of a recoding apparatus is placed, which is movable between a first position for closing the outlet and a second position for opening the outlet, the stacker comprising:

a sheet receiving face, that receives the discharged recording medium, made of a material having flexibility, and formed with at least one aperture in an upstream end portion with regard to a sheet discharging direction; and a holder, that supports the upstream end portion of the sheet receiving face, the holder including at least one retainer engaged with the aperture so as to prevent the sheet receiving face from deforming upward.

24. The stacker as set forth in claim 23, wherein the retainer is integrally formed with the holder.

25. The stacker as set forth in claim 23, wherein a plurality of apertures are arranged symmetrically with respect to a widthwise center line of the stacker.

26. The stacker as set forth in claim 23, wherein the sheet receiving face is so deformed as to be along with an outer peripheral shape of a housing of the recording apparatus, when the stacker is placed in the first position.

27. The stacker as set forth in claim 26, wherein the outer peripheral shape of the housing is curved face.

28. The stacker as set forth in claim 27, wherein a widthwise center line of the stacker is offset from a widthwise center line of the housing so that the sheet receiving face is asymmetrically deformed when the stacker is placed in the first position.

29. The stacker as set forth in claim 23, wherein the sheet receiving face is provided with a non-opaque part.

30. A recording apparatus comprising the stacker as set forth in claim 23.

31. A recording apparatus comprising:

a main body, including an inlet from which a recording medium is inserted, and an outlet from which the recording medium is discharged; and a stacker, made of a material having flexibility, which covers at least the outlet of the main body at a first position and which guides the discharged recording medium at a second position wherein the stacker has a first shape when it is at the first position and a second shape when it is at the second position.

32. The recording apparatus as set forth in claim 31, wherein the stacker is detachably coupled to the main body.

33. The recording apparatus as set forth 31, wherein the sheet receiving face is provided with a non-opaque part.

34. The recording apparatus as set forth in claim 31, wherein the stacker is provided with a display on a face which is the other side of the face on which the discharged recording medium is placed.

35. The recording apparatus as set forth in claim 31, wherein the main body has a shape so rounded as to protrude in a height direction and a depth direction thereof.

36. The recording apparatus as set forth in claim 31, wherein both side faces of the main body are broadened toward the bottom; and wherein each side face of the main body is formed with an incurved portion.

37. The recording apparatus as set forth in claim 31, further comprising a tray, made of a material having flexibility, which covers at least the inlet of the main body at a first position and which guides the recording medium to be inserted into the inlet at a second position.

38. The recording apparatus as set forth in claim 37, wherein the tray overlaps with the stacker placed in the first position when the tray is placed in the first position.

* * * * *